US006390069B1

(12) United States Patent
Jiang et al.

(10) Patent No.: US 6,390,069 B1
(45) Date of Patent: May 21, 2002

(54) FUEL INJECTOR ASSEMBLY AND INTERNAL COMBUSTION ENGINE INCLUDING SAME

(75) Inventors: He Jiang, Canton; Xiaobin Li, Livonia, both of MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/769,969

(22) Filed: Jan. 26, 2001

(51) Int. Cl.[7] ..... F02M 37/04
(52) U.S. Cl. ..... 123/506; 123/300
(58) Field of Search ..... 123/506, 514, 123/446, 496, 299–300; 239/533.6, 95, 96, 88–94

(56) References Cited

U.S. PATENT DOCUMENTS 4,958,101 A * 9/1990 Takahashi et al. ..... 310/328
4,976,245 A * 12/1990 Takahashi et al. ..... 123/506
5,036,821 A * 8/1991 Horiuchi et al. ..... 123/506
5,076,241 A * 12/1991 Takahashi et al. ..... 123/506
5,626,115 A * 5/1997 Kawaguchi ..... 123/305
6,012,430 A * 1/2000 Cooke ..... 123/467

* cited by examiner

*Primary Examiner*—Carl S. Miller
(74) *Attorney, Agent, or Firm*—Bill C. Panagos

(57) ABSTRACT

A fuel injector assembly is provided which includes a control valve actuated by a piezoelectric actuator acting through a hydraulic amplifier to facilitate pressurization of fluid fuel within the fuel injector assembly for dispersing the fuel into a combustion chamber. The piezoelectric actuator is excited by a variable voltage source to control the degree of displacement of the hydraulic amplifier to control the degree of fluid fuel dispersement by controlling the degree of displacement of the control valve. The configuration of the control valve may be such as to provide multi-step fluid fuel dispersing thereby providing a low fuel injection pressure and rate followed by a higher fuel injection pressure and rate. Multi-step fluid fuel dispersing may also be accomplished by varying the level of excitation voltage to the piezoelectric actuator. A pressure check valve is provided to prime the hydraulic amplifier cavity, to expel trapped air therefrom, to compensate for fuel leakages from the cavity and to circulate fuel through the cavity. An internal combustion engine including such a fuel injector assembly is also provided.

19 Claims, 5 Drawing Sheets

FUEL INJECTOR ASSEMBLY AND INTERNAL COMBUSTION ENGINE INCLUDING SAME

TECHNICAL FIELD

The present invention relates to a fuel injector assembly, and an internal combustion engine containing such a fuel injector assembly. The fuel injector assembly of the present invention includes a piezoelectric actuator and a hydraulical amplifier for operating a control valve to disperse fuel.

BACKGROUND ART

Modem Diesel engine design faces the dilemma of providing substantial fuel economy yet meeting increasingly more stringent emission regulations. In an effort to meet these objectives, Diesel engines have been provided with electronic controlled unit injector technology integrated with solenoid actuated control valves. Such integration has been attempted in an effort to provide precise control of the dispersing of fuel at the beginning and the end of fuel injection. The objectives have been to thereby provide precise control of fuel injection timing and quantity to improve fuel economy and emission performance.

Combustion theory and engine test results indicate that the fuel injection rate of a Diesel engine strongly affects emission and fuel economy. In general, a low injection rate during the first half of fuel injection tends to yield low $NO_x$ emission, and a higher injection rate during the second half of fuel injection appears to improve fuel economy and reduce particulate emission. Providing satisfactory fuel economy and emission performance is further complicated in that at different engine speed and load, the desirable fuel injection rate shapes are different. For a conventional electronic controlled unit injector, the fuel injection pressure versus time is a triangular shape, and the fuel injection rate is a trapezoidal shape. In a conventional electronic controlled unit injector, the initial rate is determined by needle valve open pressure and needle valve motion. The main injector rate buildup is relatively linear from the initial rate to a high rate near the end of injection. To meet the more stringent emission regulations, the next generation Diesel engine requires an additional degree of freedom in engine control whereby injection rate shape is adjusted electronically.

Efforts have been made to improve control valve response, and thereby improve the capability to control injection rate shape, by the application of piezo material for the control actuator of a Diesel fuel injector. Examples of the use of piezoelectric elements in the control of fuel injection include U.S. Pat. Nos. 5,630,550; 5,697,554 and 5,779,149 to Kurishige et al., Auwaerter et al. and Hayes, Jr., respectively.

DISCLOSURE OF THE INVENTION

An object of the present invention is to provide an improved fuel injector assembly.

Another object of the present invention is to obviate the disadvantages of the prior art by providing an improved fuel injector assembly.

Yet a further object of the present invention is to provide an improved fuel injector assembly which provides improved fuel economy and emission performance.

A further object of the present invention is to provide an improved electronic controlled unit fuel injector assembly wherein a control valve is controlled by a piezoelectric actuator and hydraulic amplifier.

Yet another object of the present invention is to provide an internal combustion engine which includes an improved fuel injector assembly which achieves one or more of the above objects.

This invention achieves these and other objects by providing a fuel injector assembly which comprises an injector body having a fuel inlet and a spill port and which is structured and arranged to disperse fluid fuel. An injector nozzle assembly is provided which is attached to the injector body and is structured and arranged to disperse fluid fuel from the injector body to a combustion chamber. A plunger is disposed within the injector body and is structured and arranged for reciprocating movement to pressurize fluid fuel within the injector body and injector nozzle assembly to disperse fluid fuel from the injector nozzle assembly to the combustion chamber. A control valve is provided which is associated with the injector body and is structured and arranged to direct the flow of fluid fuel between (a) the fuel inlet and the spill port in an open mode and (b) the fuel inlet and the injection nozzle assembly and fuel outlet to disperse fluid fuel to the combustion chamber in a closed mode. A piezoelectric actuator is provided which is associated with the injector body and is structured and arranged for excitation by a variable voltage component so that axial dimension of the piezoelectric actuator is changed upon such excitation. A hydraulic amplifier is provided which is structured and arranged to magnify such axial dimension and thereby permit opening and closing of the control valve in the open mode and the closed mode, respectively. The hydraulic amplifier comprises a first piston coupled with the piezoelectric actuator, a second piston coupled with the control valve, and a hydraulic fuel chamber therebetween. The first piston is larger than the second piston. A pressure check valve is provided which is structured and arranged to selectively supply fluid fuel from the fuel inlet to the hydraulic fuel chamber. The fluid fuel in the hydraulic fuel chamber is (a) pressurized between the first piston and the second piston, when the piezoelectric actuator is excited, to close the control valve in the closed mode, and (b) depressurized, when said piezoelectric actuator is not excited, to permit opening of the control valve in the open mode. An internal combustion engine including such a fuel injector assembly is also provided.

BRIEF DESCRIPTION OF THE DRAWINGS

This invention may be clearly understood by reference to the attached drawings wherein like elements are described by like reference numerals and in which.

MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
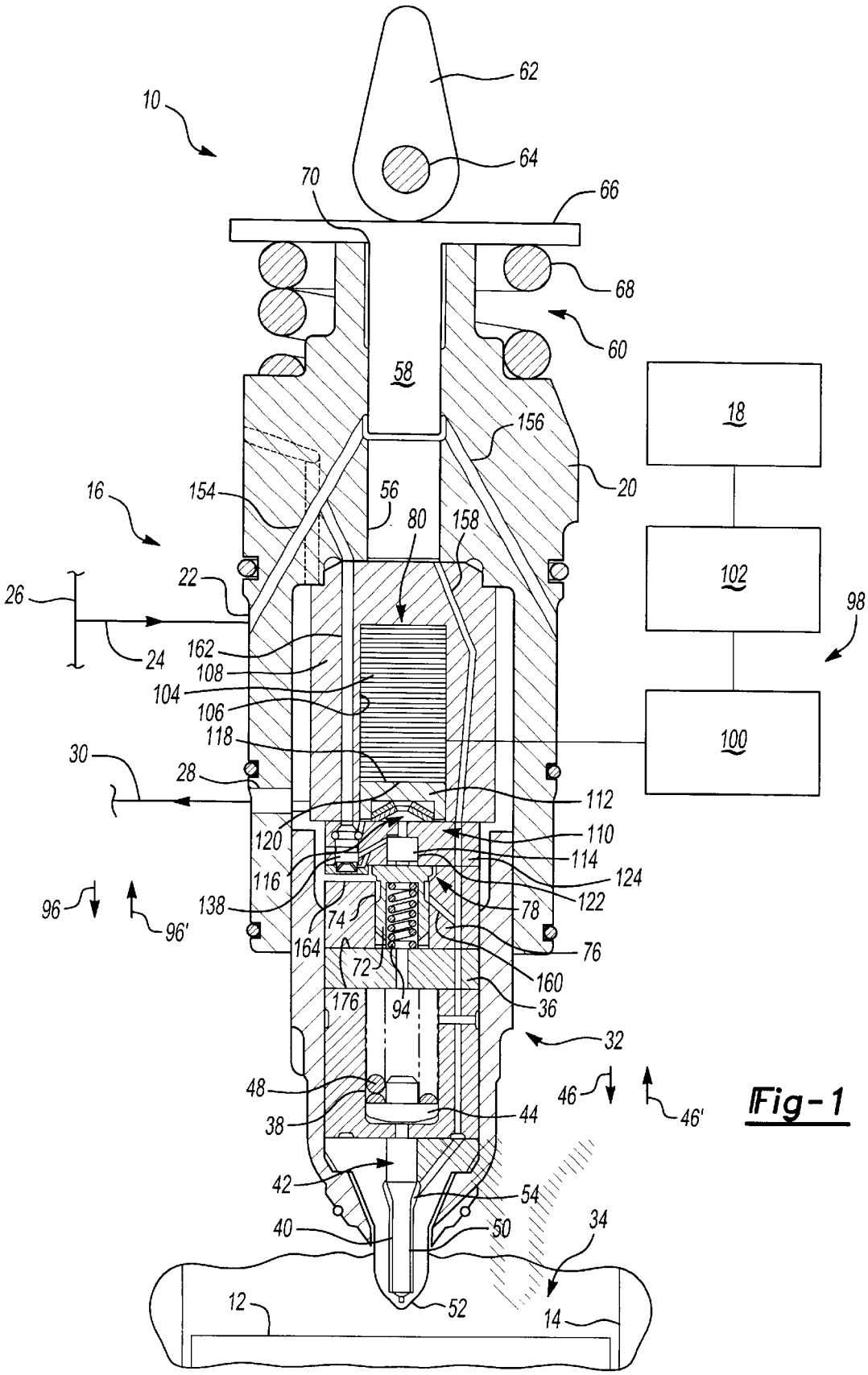
FIG. 1 is a diagrammatic representation of one embodiment of an internal combustion engine of the present invention including one embodiment of a fuel injector assembly of the present invention.

FIG. 1 illustrates one embodiment of the present invention. FIG. 1 schematically illustrates an internal combustion engine 10 which includes at least one piston 12 which reciprocates within an engine cylinder 14. A unit fuel injector assembly 16 of the present invention is also provided. Fuel injector assembly 16 is in electrical connection as described hereinafter with an electronic control module 18. Fuel injector assembly 16 extends into the engine cylinder 14 as schematically illustrated in FIG. 1 in a conventional manner.

In the embodiment illustrated in FIG. 1, the internal combustion engine 10 will include at least one piston 12 which reciprocates within a respective engine cylinder 14 into which a respective unit fuel injector assembly 16 extends in a conventional manner. Without limitation, when combined with an internal combustion engine such as, for example, a Diesel engine, typically a plurality of individual unit fuel injector assemblies 16 will be provided. Each unit fuel injector assembly will be associated with the same common fuel supply and yet will be isolated from all of the other unit fuel injector assemblies.

The fuel injector assembly 16 comprises an injector body 20 having a fuel inlet 22 coupled to a fuel supply line 24 which is coupled to the common fuel supply 26, and a spill port 28 coupled to a spill circuit 30. The fuel injector assembly 16 is structured and arranged to contain and disperse fluid fuel as described hereinafter.

The fuel injector assembly 16 includes an injector nozzle assembly 32 which is attached to the injector body 20. The injector nozzle assembly 32 extends into the engine cylinder 14 in a conventional manner and is structured and arranged for dispersing fluid fuel from the injector body 20 into the combustion chamber 34 of engine cylinder 14 as described hereinafter. As illustrated in FIG. 1, the injector nozzle assembly 32 includes a needle housing 36 mounted within the injector body 20. Housing 36 contains a chamber 38 and a chamber 40 between which a needle 42 extends. A needle portion 44 positioned within chamber 38 is urged in direction 46 by a spring 48 thereby causing a needle portion 50 positioned within chamber 40 to close a fuel outlet 52 thereby preventing dispersing of fuel. Fuel is dispersed through fuel outlet 52 and into combustion chamber 34 of engine cylinder 14 when the pressure of fuel in pressure chamber 54 of chamber 40 exceeds the force with which the spring 48 urges the needle portion 50 towards fuel outlet 52.

The injector body 20 includes a plunger cavity 56 into which extends a plunger 58. Plunger 58 is structured and arranged for reciprocating movement within the plunger cavity 56 to pressurize fluid fuel within the injector body 20 and injector nozzle assembly 32 to disperse the fuel from the injector nozzle assembly into combustion chamber 34. To this end, an actuator 60 is associated with the plunger 58. Actuator 60 is a conventional cam shaft assembly which comprises a conventional cam 62, a cam shaft 64, a cam follower 66 and a spring 68. Rotation of the cam 62 by the shaft 64 causes the cam follower 66, and plunger 58 extending therefrom at 70, to be urged towards the fuel outlet 52 as the cam rotates towards its high point. The spring 68 urges the cam follower 66 and plunger 58 away from the fuel outlet 52 as the cam 62 rotates towards its low point. The camshaft assembly illustrated in FIG. 1 is by way of example. Any other actuator may be provided to cause the plunger 58 to reciprocate within plunger cavity 56 as described herein. For example, and without limitation, the plunger may be driven by a solenoid, a push rod/rocker arm combination, a rocker arm and the like.

The fuel injector assembly 16 includes a control valve 72 associated with the injector body 20. Control valve 72 is structured and arranged to direct flow of fluid fuel between the fuel inlet 22 and the spill port 28 in an open mode of operation, and between the fuel inlet 22 and the fuel outlet 52 of the injector nozzle assembly 32 to disperse fuel to the combustion chamber 34 of the engine cylinder 14 in a closed mode, as described hereinafter.

Control valve 72 is contained within a control valve cavity 74 of a control valve housing 76 contained within the injector body 20. Control valve 72 is structured and arranged to reciprocate within cavity 74. In the embodiment illustrated in FIGS. 1 to 4, the control valve 72 and the control valve seat 78 associated with the control valve are structured and arranged to provide a reduced flow of fluid fuel through the control valve and to the spill port 28, and some dispersion of fuel at the fuel outlet 52, in a first stage of excitation of a piezoelectric actuator 80. With reference to FIGS. 1 and 3, to this end, the control valve 72 and control valve seat 78 comprise annular surfaces 82 and 84, respectively, which cooperate during the first stage of excitation as described hereinafter to form an annular passage 86. The annular passage 86 is of reduced size relative to the size of such flow passage prior to excitation, the flow passage prior to excitation being illustrated at 88 in FIG. 2.

Figure 4:
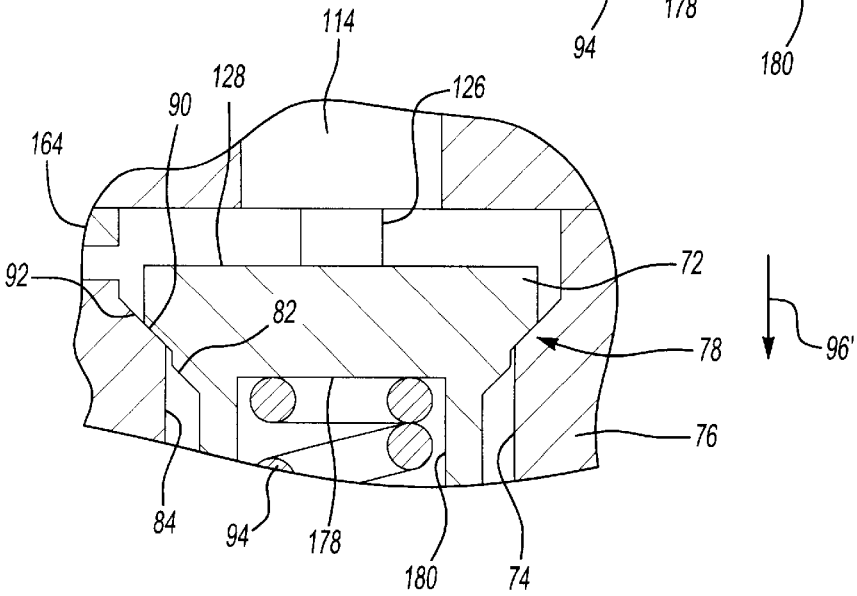

The control valve 72 and control valve seat 78 are also structured and arranged to eliminate flow of fluid fuel through the control valve and to the spill port 28, thereby permitting maximum dispersion of fuel from the fuel outlet 52 to the combustion chamber 34, in a second stage of excitation of the piezoelectric actuator 80. With reference to FIG. 4, to this end, the control valve 72 and control valve seat 78 comprise conical surfaces 90 and 92, respectively which cooperate during the second stage of excitation as described hereinafter to close the control valve to eliminate the flow of fuel therethrough. Excitation of the piezoelectric actuator 80 causes the control valve 72 to move within the control valve cavity 74 by overcoming the force exerted by control valve spring 94 which normally urges the control valve in direction 96 to the open position illustrated in FIGS. 1 and 2.

Figure 5:
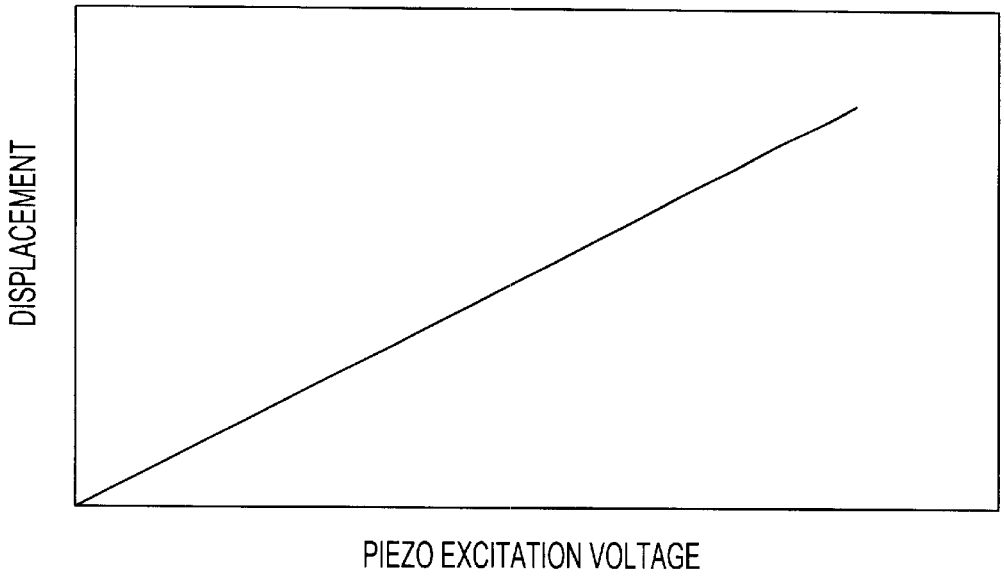
FIG. 5 is a chart which illustrates excitation voltage vs. piezo excitation displacement.

Excitation of the piezoelectric actuator 80 is effected by a voltage component 98. Excitation of the piezoelectric actuator 80 causes an axial dimension of the actuator to change. In particular, excitation of the piezoelectric actuator 80 causes the length of the actuator to increase in direction 96', the length of such change depending upon the amount of excitation voltage supplied to the piezoelectric actuator by the voltage component 98. When excitation ceases, the length of the piezoelectric actuator 80 will contract in direction 96 to its pre-excitation length. One feature of a piezoelectric actuator is that the expansion thereof is proportional to the excitation voltages as illustrated in FIG. 5. Therefore, the displacement of the piezoelectric actuator can be controlled by providing a voltage component 98 which includes a variable voltage source 100 and a variable voltage controller 102.

Without limitation, in the embodiment illustrated in FIG. 1 the piezoelectric actuator 80 is associated within the injector body 20 by being contained within the injector body. To this end, the piezoelectric actuator 80 is in the form of a piezo stack 104 contained within an actuator cavity 106 of an actuator housing 108 within the injector body 20. The variable voltage source 100 is electrically coupled to the piezo stack 104, and to the electronic control module 18 through the variable voltage controller 102. In operation, the electronic control module 18 selectively emits signals to the variable voltage controller 102 which then emits signals to the variable voltage source 100 which in response thereto provides excitation voltage to the piezo stack 104, the amount of which controls the amount of axial displacement of the piezo stack. The control valve 72 illustrated in FIGS. 1 to 4, which includes the two-step seat, takes advantage of the select control of the displacement of the piezo stack 104, as described in more detail hereinafter.

The fuel injector assembly 16 includes a hydraulic amplifier 110. The piezo stack 104 is positioned between the plunger 58 and the hydraulic amplifier 110. Hydraulic amplifier 110 is provided since the expansion of the piezo material of the piezo stack 104 is not long enough to directly drive the control valve 72. The hydraulic amplifier is structured and arranged such that the hydraulic amplifier working in combination with the piezoelectric actuator 80 permits the opening and closing of the control valve 72 in the open mode and the closed mode, respectively. In the embodiment illustrated in FIG. 1, the hydraulic amplifier 110 comprises a first piston 112 coupled with the piezo stack 104, a second piston 114 coupled with the control valve 72, and a hydraulic fuel chamber 116, therebetween. Piston 112 is larger than piston 114. In operation, the piston 112 compresses the fuel trapped in the hydraulic fuel chamber 116, and the small piston 114 amplifies the small displacement of the piezo stack 104 and the piston 112 to move the control valve 72 the desired distance as described hereinafter. Essentially, the hydraulic amplifier 110 magnifies the piezo stack displacement to a desirable level. The displacement amplification ratio of the hydraulic amplifier 110 is defined as the ratio of the diameter of the piston 112 to the diameter of the piston 114. The greater the diameter of piston 112 relative to the diameter of piston 114, the greater will be the displacement amplification ratio and the greater will be the degree of the axial movement of the control valve 72 in direction 96'.

Figure 6:
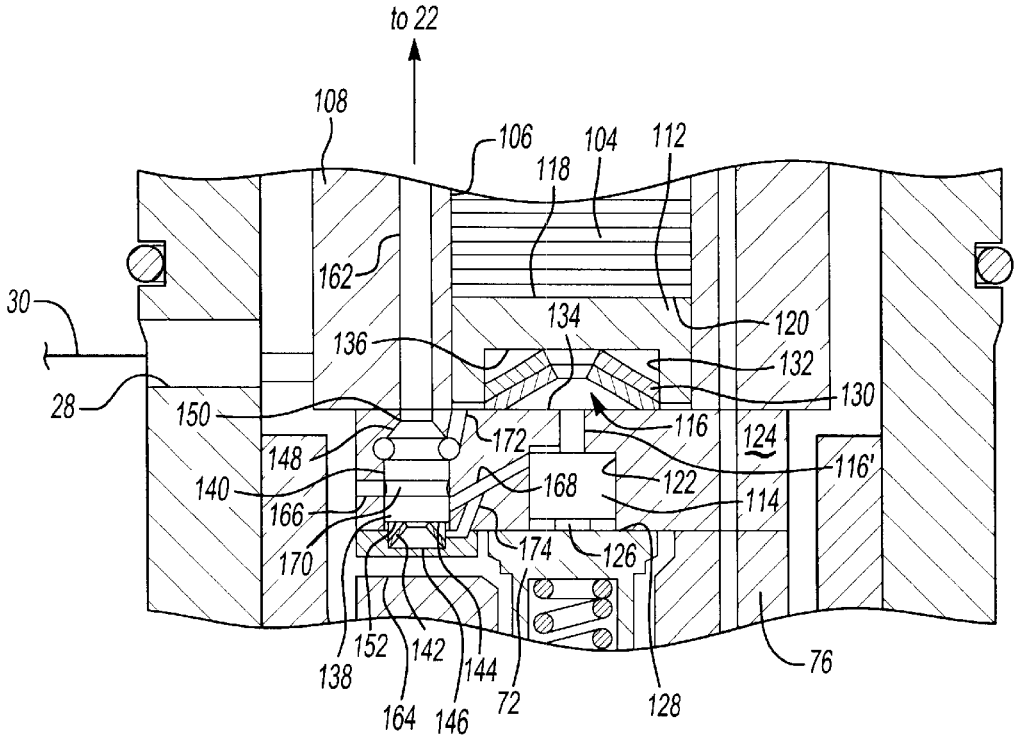
FIGS. 6 and 7 are enlarged views of a portion of the fuel injector assembly of FIG. 1 including an illustration of the pressure check valve in an open position and a closed position, respectively.

In considering the embodiment illustrated in FIG. 1, and with particular reference to enlarged FIG. 6, the piston 112 is contained within the actuator cavity 106 of the actuator housing 108, the top 118 of the piston bearing against the bottom 120 of the piezo stack 104. The piston 114 is contained in a piston cavity 122 of a housing 124. Housing 124 is sandwiched between the actuator housing 108 and the control valve housing 76. Piston 114 comprises a protuberance 126 which engages the top 128 of the control valve 72. A spring 130 is positioned within a piston aperture 132 of piston 112. Spring 130 engages the top 134 of the housing 124 and the base 136 of the aperture 132 to urge the piston 112 against the bottom 120 of the piezo stack 104. Pistons 112 and 114 are structured and arranged for reciprocation within a respective cavity 106 and 122. As explained hereinafter, hydraulic fuel chamber 116 contains fuel which hydraulically connects the piston 112 to the piston 114 through flow passage 116' in the housing 124.

The fuel injector assembly 16 illustrated in FIG. 1 includes a pressure check valve 138 structured and arranged to selectively supply fluid fuel to the hydraulic fuel chamber 116. With reference to enlarged FIG. 6, pressure check valve 138 is contained in a check valve cavity 140 of the housing 124. The pressure check valve 138 is structured and arranged to reciprocate within cavity 140. A spring 142 engages the base 144 of the valve 138 and the surface 146 of the control valve housing 76 and urges the pressure check valve against seat 148 in a closed position at inlet end portion 150. During operation of the fuel injector assembly 16, as described hereinafter, the fluid fuel in the hydraulic fuel chamber 116 is (a) pressurized between pistons 112 and 114, while the piezoelectric actuator 80 is being excited, to close control valve 72 in the closed mode, and (b) depressurized, when the piezoelectric actuator is not excited, to permit opening of the control valve in the open mode by spring 94. The pressure check valve 138 is structured and arranged to permit flow of fluid fuel through the pressure check valve, at the inlet end portion 150, from the fuel inlet 22 to the hydraulic fuel chamber 116, and to the spill port 28, when the pressure check valve is in an open mode, and to permit flow of fluid fuel from the hydraulic fuel chamber 116 to an opposite end portion 152 of the pressure check valve when the pressure check valve is in a closed mode, as described hereinafter.

In considering the fuel injector assembly 16 of FIG. 1, the plunger cavity 56 is in fluid communication with the fuel inlet 22 by flow passages 154 and 156, with the control valve cavity 74 by flow passages 158 and 160, and with the pressure chamber 54 by flow passage 158. As illustrated in FIG. 1, flow passage 158 is formed by aligned flow passages extending in actuator housing 108, housing 124, control valve housing 76 and needle housing 36. With reference to FIGS. 1 and 6, the inlet end portion 150 of the pressure check valve 138 is in fluid communication with the fuel inlet 22 by flow passages 154 and 162. As illustrated in FIG. 1, flow passage 162 is formed by aligned flow passages extending in injector body 20, actuator housing 108 and housing 124. The control valve cavity 74 is in fluid communication with the spill port 28 by flow passage 164 in the control valve housing 76. With reference to FIG. 6, the check valve cavity 140 is in fluid communication with the spill port 28 by a flow passage 166 extending in housing 124. Check valve cavity 140 is also in fluid communication, when valve 138 is in the open position, with the hydraulic fuel chamber 116 by flow passage 168 in housing 124. The pressure check valve 138 includes a circumferential groove 170 structured and arranged to place flow passage 166 in fluid communication with flow passage 168 when the pressure check valve 138 is open. In addition, a flow passage 172 in the housing 124 places the check valve cavity 140 at the inlet end portion 150 of the pressure check valve 138 in fluid communication with the hydraulic fuel chamber 116. A flow passage 174 in the housing 124 places the check valve cavity 140 at end portion 152 of the pressure check valve 138 in fluid communication with the hydraulic fuel chamber 116 through the flow passage 168 when the pressure check valve 138 is closed.

OPERATION

There follows a description of the operation of the embodiment of the fuel injection assembly of the present invention illustrated in FIGS. 1 to 7.

Figure 2:
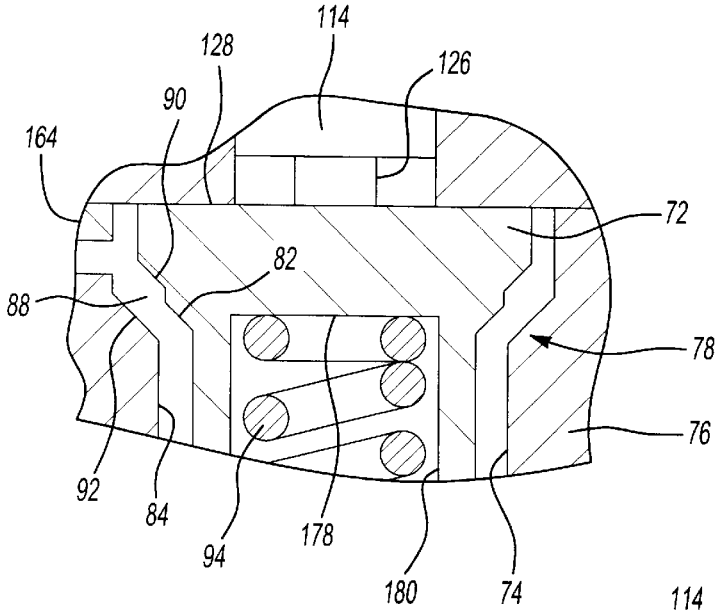
FIGS. 2 to 4 illustrate a sequential operation of the control valve of the fuel injector assembly illustrated in FIG. 1.
Figure 3:
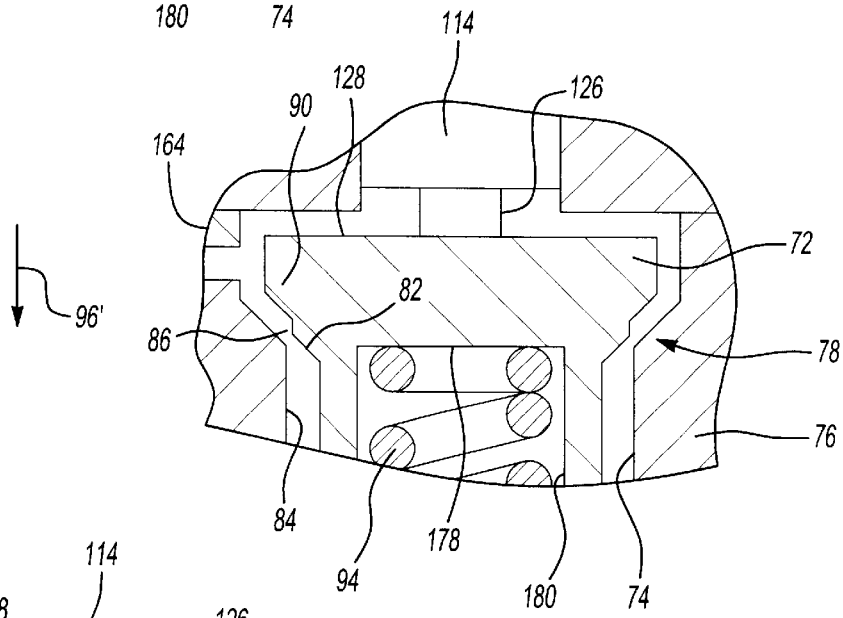

With reference to FIGS. 1, 2 and 6, prior to excitation of the piezo stack 104, control valve 72 is urged to its normal open position by spring 94, and low pressure fuel is provided in a conventional manner to the fuel injector assembly 16 at the fuel inlet 22 as a result of the connection of the fuel inlet to the common fuel supply 26 by the fuel supply line 24. Such fuel flows through passages 154 and 156 into the plunger cavity 56. Since the piezo stack 104 has not been excited, during reciprocation of the plunger 58 the fuel trapped in the plunger cavity 56 flows through passage 158 to the pressure chamber 54. Fuel also flows through passage 158 to passage 160 and then into the control valve cavity 74. Such fuel then flows from cavity 74 through the flow passage 88 provided by the open control valve 72, through passage 164 and then through spill port 28 to the spill circuit 30. Fuel also flows into passage 162 from the passage 154, such fuel flowing to the inlet end portion 150 of the pressure check valve 138. Assuming that the hydraulic fuel chamber 116 has been fully primed with fuel, the spring 142 urges the pressure check valve 138 against the seat 148 to close the pressure check valve. To this end, the spring 142 is selected having a greater spring force than the force exerted by the fuel against the inlet end portion 150 of the pressure check valve 138. The needle portion 42 will continue to be urged towards the fuel outlet 52 by spring 48 to close the fuel outlet, the spring force exerted against needle portion 44 acting in direction 46 being greater than the force exerted against the needle portion 42 in direction 46' by the fuel in the pressure chamber 54.

With reference to FIGS. 1, 3, 4 and 7, the electronic control module 18 is programmed to cause fuel to be dispersed into the combustion chamber 34 as desired. In particular, in a first sealing step the electronic control module 18 emits control signals to the variable voltage controller 102 when it is desired to begin dispersing fuel into the combustion chamber 34. In response to such signals, the variable voltage controller 102 signals the variable voltage source 100 to provide the voltage excitation required to excite the piezo stack 104 in a first stage of excitation sufficiently to cause instantaneous axial expansion of the piezo stack a first distance in direction 96', overcoming the force exerted by spring 130 against the base 136 of the piston 112. In particular, such elongation of the piezo stack 104 in direction 96' causes the bottom 120 of the piezo stack to be urged against the top 118 of the piston 112 thereby moving the piston 112 a first distance in direction 96'. Such movement causes movement of the piston 114 in direction 96' due to the hydraulic connection effected by the fuel contained within the hydraulic fuel chamber 116, such fuel essentially hydraulically connecting pistons 112 and 114 through flow passage 116'. Although the spring 94 extends from the top 176 of the needle housing 36 to the base 178 of the spring cavity 180 and thereby normally urges the control valve 72 in an open position as illustrated in FIGS. 1 and 2, due to the engagement of the protuberance 126 with the upper surface 128 of the control valve, movement of the piston 114 a first distance in direction 96' causes movement of the control valve a first distance in direction 96' to the partially closed position illustrated in FIG. 3. This is possible because the spring 94 selected exerts a spring force against the base 178 which will be less than the force exerted by the protuberance 126 against the upper surface 128 when the piezo stack 104 is excited. As the control valve 72 is urged in direction 96', the size of the annular passage between annular surfaces 82 and 84 decreases from that illustrated in FIG. 2 at 88 to that illustrated in FIG. 3 at 86. During this first sealing step illustrated in FIG. 3, the control valve 72 is about half closed thereby providing the smaller annular clearance at 86. Subsequently, in a second sealing step, the electronic control module 18 emits further control signals to the variable voltage controller 102 in response to which the variable voltage controller signals the variable voltage source 100 to increase voltage excitation of the piezo stack 104 sufficiently to cause further elongation of the piezo stack in direction 96' in a second stage of excitation thereby moving the piston 112 a second distance in direction 96'. Such movement causes further movement of the piston 114 in direction 96' which further moves the control valve 72 a second distance in direction 96' to the fully closed position illustrated in FIG. 4 wherein conical surface 92 sealingly engages conical surface 90. As a result of the foregoing two stage operation, the build-up of the pressure of the fuel in plunger cavity 56 and the pressure chamber 54, as the plunger 58 is urged in direction 96' as the cam 62 rotates toward the engagement of its high point with the cam follower 66, is slower initially during the first sealing step when the control valve 72 is partially open than during the second sealing step when the control valve is completely closed. The result of such a two-step operation is that during the pressure build-up during the first sealing step, the pressure of the fuel in pressure chamber 54 will become sufficient to overcome the spring force of spring 48 and urge needle portion 42 in direction 46' to open fuel outlet 52 and disperse fuel into combustion chamber 34 at a relatively lower initial injection rate and injection pressure than during the pressure build-up during the second sealing step. The timing of the transition from low rate to high rate fuel pressure and injection is controlled by the electronic control module 18 as desired. The end of fuel injection occurs when the piezo actuator is deactivated. In particular, the electronic control module 18 signals the variable voltage controller 102 to signal the variable voltage source 100 to cease voltage excitation of the piezo stack 104. At this point, the piezo stack 104 contracts, and the spring 130 urges the piston 112 in direction 96 to its initial position illustrated in FIG. 1. Such movement of the piston 112 causes the pressure in the hydraulic fuel chamber 116 to drop, allowing the spring 94 to urge the control valve 72 and piston 114 in direction 96 to their initial position illustrated in FIGS. 1 and 2. In such position, the control valve 72 will be fully open, and the fuel pressure within pressure chamber 54 will fall lower than the needle valve closing pressure effected upon the needle portion 42 by spring 48 thereby permitting spring 48 to urge needle portion 42 to close fuel outlet 52 and stop fuel injection into combustion chamber 34. The lowering of pressure in pressure chamber 54 results from the opening of the control valve 72 and the resulting flow of fuel through the control valve and to the spill circuit 30 as described above.

Figure 7:
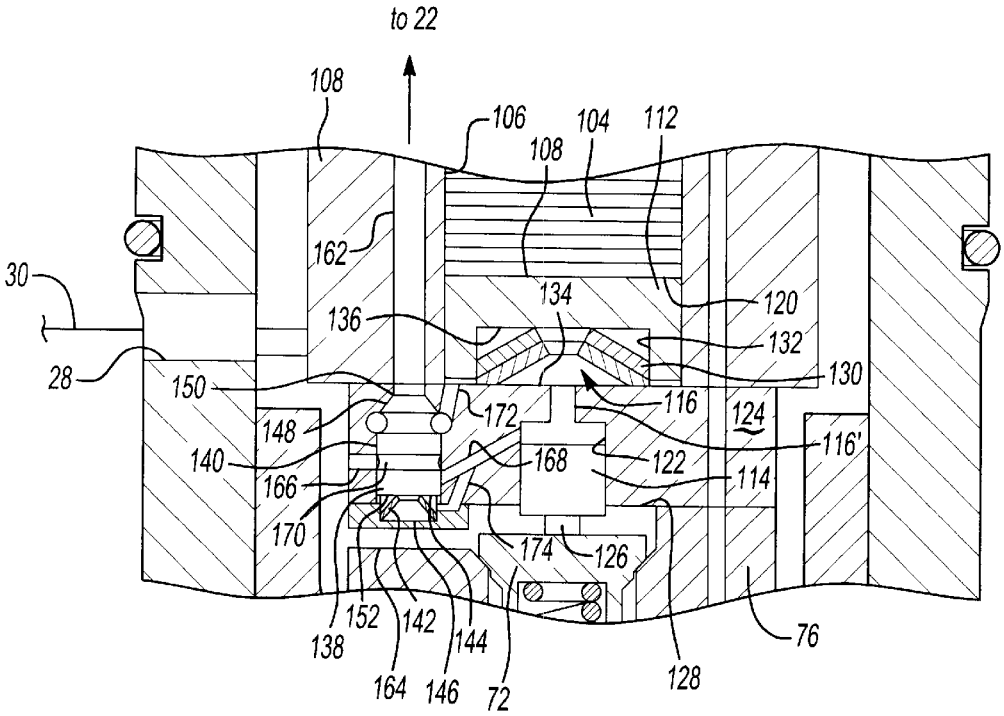

In order to ensure that the hydraulic amplifier 110 functions properly, the hydraulic fuel chamber 116 should be filled with fluid fuel without any cavitation. The pressure check valve 138 is provided for this purpose. During operation, some of the typically low-pressure fuel provided at fuel inlet 22 is bypassed to the inlet end portion 150 of the pressure check valve 138 through passages 154 and 162. As noted above, the pressure check valve 138 is normally closed by spring 142 as illustrated in FIG. 6. However, if there is cavitation in the hydraulic fuel chamber 116, the force exerted against the inlet end portion 150 by the fuel in passage 162 will overcome the spring force of spring 142 and cause the pressure check valve to open as illustrated in FIG. 7. When in such open position, flow passage 166 is in fluid communication with flow passage 168 by the groove 170 in the outer surface of the pressure check valve 138, as illustrated in FIG. 7. In this manner, there is fuel communication between the hydraulic fuel chamber 116 and the spill circuit 30. In operation, when the pressure check valve 138 is open, fuel will flow from passage 162, into valve cavity 148, through passage 172 and into the hydraulic fuel chamber 116. When the hydraulic fuel chamber 116 is filled, the pressure check valve 138 will remain open until any air bubbles present in the hydraulic fuel chamber 116 is removed. To this end, the flow of fuel from fuel inlet 22 to the hydraulic fuel chamber 116, through passages 168 and 166 joined by groove 170, and into the spill circuit 30 will flash out the air bubbles. The pressure check valve 138 will then be urged against seat 148 by spring 142 thereby closing the pressure check valve. Opening of the pressure check valve 138 as described above also serves to prime the hydraulic fuel chamber 116, compensate for fuel leakage losses from chamber 116 and create partial fuel circulation for chamber 116 during operation.

Figure 8:
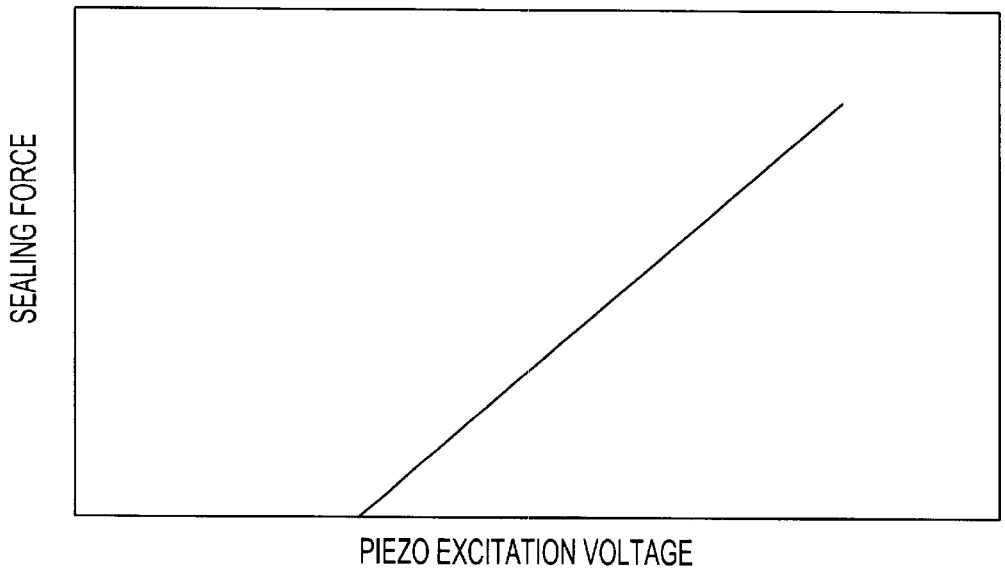
FIG. 8 is a chart which illustrates piezo excitation voltage vs. control valve sealing force.
Figure 9:
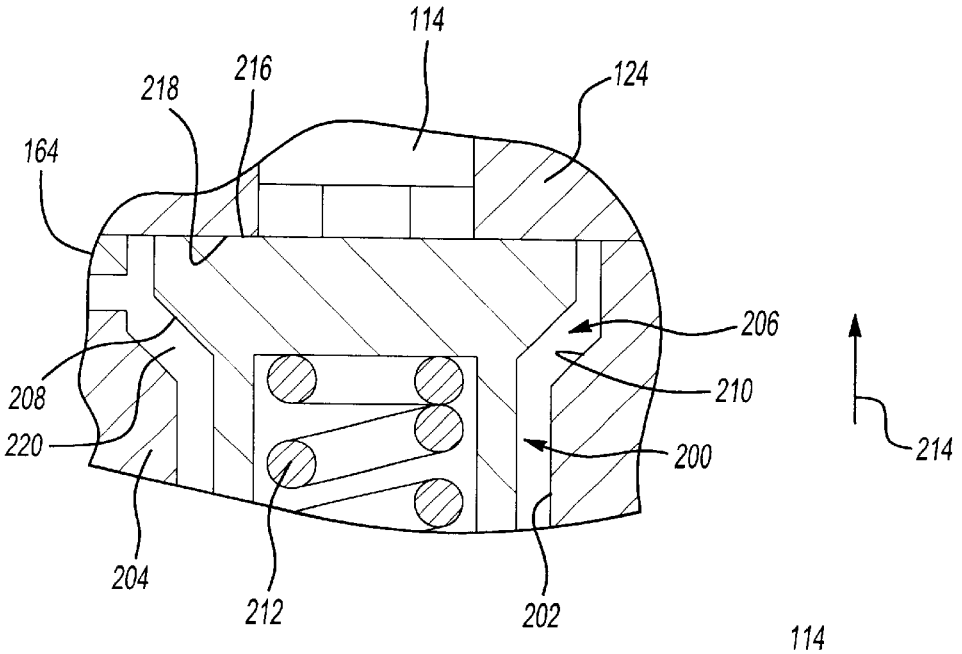
FIGS. 9 and 10 illustrate an alternative embodiment of the control valve of FIG. 1 in an open and closed position, respectively.
Figure 10:
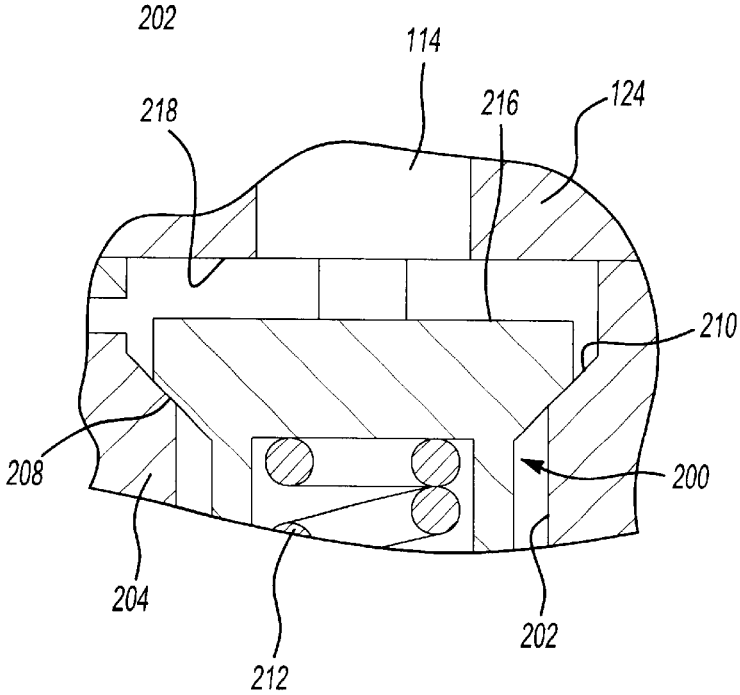

Another feature of the piezoelectric actuator 80 of the present invention is that for the same actuation displacement of the piezoelectric actuator, the sealing force of the control valve is proportional to the excitation voltage as illustrated in FIG. 8. To take advantage of this feature, the alternative control valve 200 of FIGS. 9 and 10 may be provided. Control valve 200 is provided with a one-step conical sealing configuration. In this embodiment, control valve 200 replaces control valve 72 and to this end is positioned within a control valve cavity 202 which replaces control valve cavity 74. Control valve 200 is contained within control valve cavity 202 of a control valve housing 204 which replaces control valve housing 76. Control valve 200 is structured and arranged to reciprocate within cavity 202. Control valve 200 and control valve seat 206 comprise conical surfaces 208 and 210, respectively, which cooperate to control the seating of the valve. FIG. 9 illustrates control valve 200 completely open and FIG. 10 illustrates it completely closed. In considering FIG. 9, the piezo stack 104 has not been excited, and the spring 212 urges the control valve 200 in direction 214 to an entirely open position, the top 216 of the control valve engaging the bottom 218 of the housing 124 and the passage 220 being thereby formed for flow of fuel from cavity 202, through passage 164 to the spill circuit 30. In considering FIG. 10, the piezo stack 104 has been excited with sufficient excitation voltage to cause the piston 114 to urge the control valve 200 in direction 222 until the surface 208 engages the surface 210 to close the control valve. Movement of the control valve 200 in this manner is effected in the same way in which the piston 114 moves control valve 72 in direction 96' as described above except that it involves a one step operation rather than the two step operation regarding control valve 72. In addition, by controlling the degree of excitation voltage provided by the variable voltage source 100, the sealing force at the interface of surfaces 208 and 210 can be controlled to (a) allow for some fuel leakage through the control valve and (b) to prevent any leakage therethrough, as desired. For example, the electronic control module 18 can be programmed to activate the variable voltage controller 102 so that it signals the voltage source 100 to provide the piezo stack 104 with sufficient low excitation voltage to close the control valve 200 yet allow a desirable level of leakage at the interface between surfaces 208 and 210 due to insufficient sealing force at such interface. In this manner, the initial fuel injection pressure and injection rate may be lower than the final fuel injection pressure and injection rate as is also the case regarding the initial and final fuel injection rate and pressure of the embodiment of FIG. 1. To this end, the electronic control module 18 can be further programmed to activate the variable voltage controller 102 so that it signals the voltage source 100 to provide the piezo stack 104 with sufficient high excitation voltage to prevent any leakage through control valve 72 by providing sufficient sealing force at the interface of surfaces 208 and 210. In this manner, the final injection pressure and injection rate may be higher than the initial injection pressure and injection rate.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A fuel injector assembly, comprising:

an injector body having a fuel inlet, a spill port and being structured and arranged to contain and disperse fluid fuel;

an injector nozzle assembly including a fuel outlet, said nozzle assembly being attached to said injector body and structured and arranged for dispersing fluid fuel from said fuel outlet to a combustion chamber;

a plunger disposed within said injector body and structured and arranged for reciprocating movement to pressurize fluid fuel within said injector body and said injector nozzle assembly to disperse fluid fuel from said fuel outlet to a combustion chamber;

a control valve and a control seat associated with said control valve, said control valve associated with said injector body and structured and arranged to direct flow of fluid fuel between (a) said fuel outlet and said spill port in an open mode and (b) said fuel inlet and said injector nozzle assembly and fuel outlet to disperse fluid fuel to said combustion chamber in a closed mode;

a piezoelectric actuator associated with said injector body and structured and arranged for voltage excitation, an axial dimension of said actuator being changed upon said excitation, said control valve and associated control seat are structured and arranged (a) to provide a reduced flow of fluid fuel through said control valve and to said spill port, and to provide some dispersion of fuel at said fuel outlet into said combustion chamber, in a first stage of excitation of said piezoelectric actuator and (b) to eliminate flow of fluid fuel through said control valve and to said spill port, thereby permitting maximum dispersing of fuel from said fuel outlet to said combustion chamber, in a second stage excitation of said piezoelectric actuator;

a hydraulic amplifier structured and arranged to magnify said axial dimension and thereby permit opening and closing of said control valve in said open mode and said closed mode, respectively, said hydraulic amplifier comprising a first piton coupled with said actuator, a second piston coupled with said control valve and a hydraulic fuel chamber therebetween;

and a pressure check valve structured and arranged to selectively supply fluid fuel from said fuel inlet to said hydraulic fuel chamber, said fluid fuel in said hydraulic fuel chamber being (a) pressurized between said first piston and said second piston, when said piezoelectric actuator is excited, to close said control valve in said closed mode, and (b) depressurized, when said piezoelectric actuator is not excited, to permit opening of said control valve in said open mode.

2. The fuel injector assembly of claim 1 wherein said piezoelectric actuator comprises a piezo stack contained within said injector body between said plunger and said hydraulic amplifier.

3. The fuel injector assembly of claim 1 wherein said hydraulic amplifier has a displacement application ratio defined by the diameter of said first piston to the diameter of said second piston.

4. The fuel injector assembly of claim 1 wherein displacement of said piezoelectric actuator is controlled by a variable voltage component.

5. The fuel injector assembly of claim 1, wherein said control valve and said control valve seat comprise respective annular surfaces which cooperate to form an annular flow passage to provide said reduced fuel flow, and further comprise respective conical surfaces which cooperate to close said control valve to provide said eliminated flow.

6. The fuel injector assembly of claim 4 wherein sealing force of said control valve can be varied by applying different levels of excitation voltages to said piezoelectric actuator.

7. The fuel injector assembly of claim 1 wherein said control valve and a control valve seat associated with said control valve are structured and arranged to provide cooperating conical seating surfaces which (a) provide a flow passage for fluid fuel to flow through said control valve to said spill port when said piezoelectric actuator is not excited and (b) vary the degree of flow, if any, of fluid fuel through said control valve to said spill port by varying the sealing force at said seating surfaces when said piezoelectric actuator is excited.

8. The fuel injector assembly of claim 7 wherein said sealing force can be varied by applying different levels of excitation voltages to said piezoelectric actuator.

9. The fuel injector assembly of claim 1 wherein said pressure check valve is structured and arranged to permit flow of fluid fuel through said pressure check valve, at an inlet end, from said fuel inlet to said hydraulic fuel chamber and to said spill port, when said pressure check valve is in an open mode, and to permit flow of fluid fuel from said hydraulic fuel chamber to an opposite end portion of said pressure check valve when said pressure check valve is in a closed mode.

10. In an internal combustion engine which includes at least one piston which reciprocates with an engine cylinder and a fuel injector assembly which is in electrical connection with an electronic control module and extends into said cylinder, wherein the improvement comprises said fuel injector assembly comprising:

an injector body having a fuel inlet, a spill port coupled to a spill circuit, and being structured and arranged to contain and disperse fluid fuel;

an injector nozzle assembly including a fuel outlet, said nozzle assembly being attached to said injector body, extending into an engine cylinder and being structured and arranged for dispersing fluid fuel from said fuel outlet to a combustion chamber of said engine cylinder;

a plunger disposed within said injector body and structured and arranged for reciprocating movement to pressurize fluid fuel within said injector body and said injector nozzle assembly to disperse fluid fuel from said fuel outlet to a combustion chamber;

an actuator associated with said plunger and structured and arranged for reciprocating said plunger in said plunger cavity;

a control valve and a control seat associated with said control valve, said control valve associated with said injector body and structured and arranged to direct flow of fluid fuel between (a) said fuel outlet and said spill port in an open mode and (b) said fuel inlet and said injector nozzle assembly and fuel outlet to disperse fluid fuel to said combustion chamber in a closed mode;

a voltage component;

a piezoelectric actuator associated with said injector body and structured and arranged for voltage excitation by said voltage component, an axial dimension of said actuator being changed upon said excitation, said control valve and associated control seat are structured and arranged (a) to provide a reduced flow of fluid fuel through said control valve and to said spill port, and to provide some dispersion of fuel at said fuel outlet into said combustion chamber, in a first stage of excitation of said piezoelectric actuator and (b) to eliminate flow of fluid fuel through said control valve and to said spill port, thereby permitting maximum dispersing of fuel from said fuel outlet to said combustion chamber, in a second stage excitation of said piezoelectric actuator;

an electronic control module electrically connected to said voltage component, said electronic control module selectively emitting electronic control module signals to actuate said voltage component and excite said piezoelectric actuator;

a hydraulic amplifier structured and arranged to magnify said axial dimension, and thereby permit opening and closing of said control valve in said open mode and said closed mode, respectively, said hydraulic amplifier comprising a first piston coupled with said actuator, a second piston coupled with said control valve, and a hydraulic fuel chamber therebetween;

and a pressure check valve structured and arranged to selectively supply fluid fuel from said fuel inlet to said hydraulic fuel chamber, said fluid fuel in said hydraulic fuel chamber being (a) pressurized between said first piston and said second piston, when said piezoelectric actuator is excited, to close said control valve in said closed mode, and (b) depressurized, when said piezoelectric actuator is not excited, to permit opening of said control valve in said open mode.

11. The internal combustion engine of claim 10 wherein said piezoelectric actuator comprises a piezo stack contained within said injector body between said plunger and said hydraulic amplifier.

12. The internal combustion engine of claim 10 wherein said hydraulic amplifier has a displacement application ratio defined by the diameter of said first piston to the diameter of said second piston.

13. The internal combustion engine of claim 10 wherein displacement of said piezoelectric actuator is controlled by a variable voltage component.

14. The internal combustion engine of claim 10 wherein said control valve and a control valve seat associated with said control valve are structured and arranged (a) to provide a reduced flow of fluid fuel through said control valve and to said spill port, and provide some dispersion of fuel at said fuel outlet into said combustion chamber, in a first stage of excitation of said piezoelectric actuator and (b) to eliminate flow of fluid fuel through said control valve and to said spill port, thereby permitting maximum dispersion of fuel from said fuel outlet to said combustion chamber, in a second stage of excitation of said piezoelectric actuator.

15. The internal combustion engine of claim 10, wherein said control valve and said control valve seat comprise respective annular surfaces which cooperate to form an annular flow passage to provide said reduced fuel flow, and further comprise respective conical surfaces which cooperate to close said control valve to provide said eliminated flow.

16. The internal combustion engine of claim 13 wherein sealing force of said control valve can be varied by applying different levels of excitation voltages to said piezoelectric actuator.

17. The internal combustion engine of claim 10 wherein said control valve and a control valve seat associated with said control valve are structured and arranged to provide cooperating conical seating surfaces which (a) provide a flow passage for fluid fuel to flow through said control valves to said spill port when said piezoelectric actuator is not excited and (b) vary the degree of flow, if any, of fluid fuel through said control valve to said spill port by varying the sealing force at said seating surfaces when said piezoelectric actuator is excited.

18. The internal combustion engine of claim 17 wherein said sealing force can be varied by applying different levels of excitation voltages to said piezoelectric actuator.

19. The internal combustion engine of claim 10 wherein said pressure check valve is structured and arranged to permit flow of fluid fuel through said pressure check valve, at an inlet end, from said fuel inlet to said hydraulic fuel chamber and to said spill port, when said pressure check valve is in an open mode, and to permit flow of fluid fuel from said hydraulic fuel chamber to an opposite end portion of said pressure check valve when said pressure check valve is in a closed mode.

* * * * *